US006661398B2

(12) United States Patent
Iwasaki

(10) Patent No.: US 6,661,398 B2
(45) Date of Patent: Dec. 9, 2003

(54) DISPLAY DEVICE, IMAGE FORMING APPARATUS, RECORDING MEDIUM AND DISPLAY METHOD

(75) Inventor: Kazuya Iwasaki, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 302 days.

(21) Appl. No.: 09/819,897

(22) Filed: Mar. 29, 2001

(65) Prior Publication Data

US 2001/0045944 A1 Nov. 29, 2001

(30) Foreign Application Priority Data

Mar. 31, 2000 (JP) ..... 2000-098613
Mar. 14, 2001 (JP) ..... 2001-072875

(51) Int. Cl.[7] ..... G09G 3/32
(52) U.S. Cl. ..... 345/82
(58) Field of Search ..... 345/33, 44, 46, 345/82, 83, 204, 211, 212, 213, 214; 713/300, 320, 322, 323, 324, 340; 340/815.45

(56) References Cited

U.S. PATENT DOCUMENTS 5,451,979 A * 9/1995 Levac ..... 345/82
5,796,391 A * 8/1998 Chiu et al. ..... 345/204

FOREIGN PATENT DOCUMENTS

JP 6-2391 1/1994

* cited by examiner

*Primary Examiner*—Chanh Nguyen
*Assistant Examiner*—Paul A. Bell
(74) *Attorney, Agent, or Firm*—Oblon, Spivak, McClelland, Maier & Neustadt, P.C.

(57) ABSTRACT

In a display device, first and second driving parts are connected with light-emitting diodes disposed in a matrix configuration in series, and the light-emitting diodes are lit when the first and second driving parts are driven simultaneously. Driving of at least one of the first and second driving parts is curtailed in a case of a predetermined operation mode.

20 Claims, 7 Drawing Sheets

IT IS POSSIBLE TO CHANGE BY CONDITION CHANGE OF STEPS OF '*' INTO THAT ONLY DATA IS TO BE OFF OR BOTH COM & DATA ARE TO BE OFF

IT IS POSSIBLE TO CHANGE BY CONDITION CHANGE OF STEP OF '*' INTO THAT ONLY DATA IS TO BE OFF OR ONLY COM TO BE IS OFF

IT IS POSSIBLE TO CHANGE BY CONDITION CHANGE OF STEP OF '*' INTO THAT ONLY DATA IS TO BE OFF OR BOTH COM & DATA ARE TO BE OFF

DISPLAY DEVICE, IMAGE FORMING APPARATUS, RECORDING MEDIUM AND DISPLAY METHOD

BACKGROUND OF THE INVENTION

1. Field of the Invention

The present invention generally relates to a display device, an image forming apparatus, a recording medium and a display method, and, in particular, to a display device employing light emitting diodes, an image forming apparatus using the display device, a recording medium storing a program for controlling the display device, and a display method of displaying using light emitting diodes.

2. Description of the Related Art

Recently, saving power of an image forming apparatus such as a copier, a printer, a facsimile machine or the like has been demanded strongly. In fact, even there is a standard in which a power consumption at a time of a standby mode is less than 10 W, and, also, each of a returning time required for returning from the standby mode to a normal mode and a shifting time required for changing from the normal mode to the standby mode is less than ten seconds.

In such a situation, a power saving method which has been employed in an image forming apparatus in the related art having an operation panel employing LEDs (light-emitting diodes), specifically, a power saving method in which almost all parts of the apparatus including the operation panel other than a partial circuit are disconnected from the power source, may cause inconvenience to a user. Accordingly, a new power saving method should be considered. In particular, when an arrangement is made such that shift from the normal mode to the standby mode is automatically performed quickly, the operation panel may be disconnected from the power source when a predetermined time has elapsed while no operation is performed by a user on the operation panel by some reason even during operation for changing an operation condition or the like of the apparatus. Thereby, display of the operation condition which is being set may be extinguished from the operation panel unexpectedly, or the operation condition itself may be erased unexpectedly. Thus, serious inconvenience on use may occur.

Further, although the LEDs on the operation panel are effective displaying measures for displaying operation states of respective parts in the image forming apparatus, a power saving method concerning driving of the LEDs is very important in the above-mentioned trend because the driving power consumption by the LEDs is very large.

There are two types of LED driving methods. One thereof is a static driving method in which an LED driving unit is provided for each LED. The other one is a dynamic driving method in which many LEDs arranged in a form of a matrix are driven by a time-division manner by a combination of a relatively small number of a common driver and a data driver. In a case of using many LEDs, the latter method is used in many cases.

Japanese Laid-Open Utility-Model Application No. 6-2391 discloses an LED driving circuit employing a power saving technique for the dynamic driving method. In this circuit, constant-current ICs are used as the above-mentioned data driver, and, as a power source for driving LEDs, a low-voltage power source is used in addition to a power source for driving a control circuit. That is, by using a low voltage for driving the LEDs, it is possible to reduce power consumption in the LED panel.

The above-described LED driving circuit disclosed by Japanese Laid-Open Utility-Model Application No. 6-2391 is suitable for a use in an arrangement having very many LEDs which are single color light emitting LEDs. However, as in an operation panel in an image forming apparatus, having a number of LEDs of total several tens or less, and, also, emitting a plurality of colors, a problem occurs. This is because, in such a case, a special power source only for driving the LEDs is needed although the number of the LEDs is small, and, also, different constant-current ICs are needed for LEDs emitting light of different colors. Further, at a time the image forming apparatus returns from the standby mode to the normal mode, there is a somewhat delay from a time a user operates the operation panel. Accordingly, it is necessary that there is a clear difference between the standby mode and normal mode in the operation panel easily noticeable by the user.

SUMMARY OF THE INVENTION

The present invention has been devised in consideration of the above-mentioned situations.

In a display device, according to the present invention, in which first and second driving parts are connected with in series so as drive in a time-division manner light-emitting diodes disposed in a matrix configuration, and the light-emitting diodes are lit when the first and second driving parts are driven simultaneously, driving of at least one of the first and second driving parts is curtailed according to a predetermined operation mode.

A driving period of at least one of the first and second driving parts may be dynamically changed (period-2, shown in FIG. 2B) according to the predetermined operation mode. In the other words, a non-driving period (the period subsequent to the period-1, shown in FIG. 2B) of at least one of the first and second driving parts may be inserted.

A non-driving cycle (fifth cycle of each driving period in the example shown in FIG. 2C) in which at least one of the first and second driving parts is not driven may be inserted into a driving period of the first and second driving parts according to the predetermined operation mode.

An output time interval of at least one of the first and second driving parts may be changed/shortened according to the predetermined operation mode (as shown in FIG. 2D).

Thereby, it is possible to render power saving when an image forming apparatus or the like to which the display device according to the present invention is applied enters the predetermined mode (standby mode), without changing a basic program of the apparatus, by appropriately curtailing the driving of the LEDs. Furthermore, when the apparatus enters the standby mode, this matter can be clearly indicated to a user by changing the brightness of the LEDs.

Further, power consumption of the display device and the light emitting intensity of the LEDs in the standby mode can be freely set through control of the frequency of the curtailed driving, the ratio/rate of the non-driving cycle, or the driving time interval.

Other objects and further features of the present invention will become more apparent from the following detailed description when read in conjunction with the accompanying drawings.

DETAILED DESCRIPTION OF THE PREFERRED EMBODIMENTS

Figure 1:
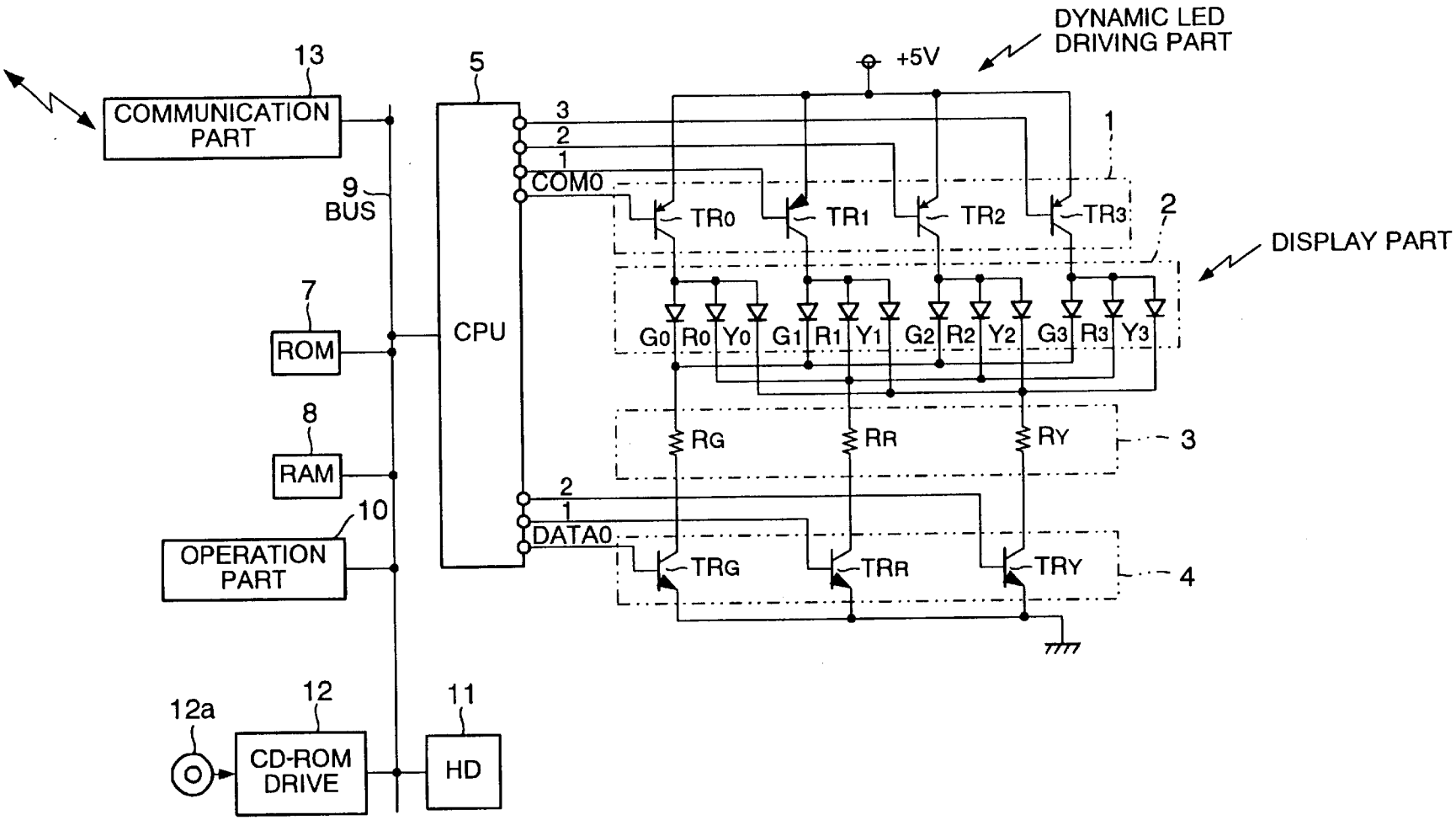
FIG. 1 shows a circuit diagram of a dynamic driving part for LEDs disposed in a 4×3 matrix configuration in each of a first, second and third embodiments of the present invention.

Operation of a display device of an image forming apparatus in first, second and third embodiments of the present invention will now be described with reference to FIGS. 1 and 2A through 2D. FIG. 1 shows a circuit diagram illustrating one example of an LED dynamic driving part (display device) employing a 4×3 matrix included in an operation panel of the image forming apparatus.

As shown in FIG. 1, the LED dynamic driving part includes a common driver 1 including 4 PNP transistors $TR_0$ through $TR_3$, a data driver 4 including 3 NPN transistors $TR_G$, $TR_R$ and $TR_Y$, and a group of LEDs 2 arranged in a form of 4×3 matrix, driven by the above-mentioned two drivers 1 and 4. Further, the LED dynamic driving part includes a group of current-controlling resistors 3 disposed in common for a plurality of LEDs of respective common light emitting colors for controlling currents flowing through these LEDs (in this example, the three resistors $R_G$, $R_R$ and $R_Y$ corresponding respective light emitting colors to green, read and yellow, having different resistance values). Generally, in order to render uniform brightness among LEDs of different light emitting colors, respective different driving currents are needed. For this purpose, the resistance values of the resistors $R_G$, $R_R$ and $R_Y$ are different from each other.

A CPU 5 shown in FIG. 1 performs control of the above-mentioned image forming apparatus, and, according to predetermined conditions, outputs a driving signal for driving in a time-division manner the driving transistors specified in the above-mentioned two drivers, to any of output ports COM 0 through COM 3, and/or any of output ports DATA 0 through DATA 2.

The CPU 5 controls the entirety of the image forming apparatus including the LED dynamic driving part, based on programs stored in a ROM 7 and information stored in a RAM 8.

The emitters of the PNP transistors $TR_0$ through $TR_3$ of the common driver 1 are connected to a power source of 5 volts, the collectors thereof are connected to anodes of the plurality of LEDs of the different light emitting colors (green ($G_i$), red ($R_i$) and yellow ($Y_i$); i=0 through 3 in the example) disposed at respective positions of the group of LEDs 2. Further, the bases of the transistors $TR_0$ through $TR_3$ are connected to respective ones of the output ports COM 0 through COM 3 of the CPU 5. When the time-division driving signal output to any one of the output ports COM 0 through COM 3 is in its high (H) level, the corresponding one of the transistors $TR_0$ through $TR_3$ is in its OFF state. When the time-division driving signal output to any one of the output ports COM 0 through COM 3 is in its low (L) level, the corresponding one of the transistors $TR_0$ through $TR_3$ is in its ON state.

The respective NPN transistors $TR_G$, $TR_R$ and $TR_Y$ of the data driver 4 are provided for the respective light emitting colors (three, in the example). The emitter of each thereof is grounded, the collector thereof is connected to the cathodes of the LEDs of the respective one of the light emitting colors via the respective one of the current-controlling resistors $R_G$, $R_R$ and $R_Y$. Further, the base of each of the transistors $TR_G$, $TR_R$ and $TR_Y$ is connected to the respective one of the output ports DATA 0 through DATA 2 of the CPU 5. While the time-division driving signal output to one of the output ports DATA 0 through DATA 2 is in its low (L) level, the respective one of the transistors $TR_G$, $TR_R$ and $TR_Y$ is in its OFF state. When the time-division driving signal enters its high (H) level, the respective one of the transistors $TR_G$, $TR_R$ and $TR_Y$ enters its ON state.

Accordingly, when the voltage level at the base of any one of the PNP transistors $TR_i$ (i=0 through 3) of the common driver 1 is made "L", and, simultaneously, the voltage level of the base of any one of the NPN transistors $TR_j$ (j=G, R, Y) of the data driver 4 is made "H", the LED disposed at the thus-selected cross point (i, j) has a current flowing therethrough and is lit.

With reference FIGS. 2A through 2D, the operation of the display device in the first, second and third embodiments of the present invention will now be described. FIGS. 2A through 2D are time charts showing output waveforms at the output ports COM 0 through COM 3 and DATA 0 through DATA 2 of the CPU 5. To the output ports COM 0 through COM 3, the driving signal of "L" level is output for a predetermined time interval according to an order allocated thereto for each period. By this driving signal, the corresponding PNP transistors are made ON for these time intervals in sequence.

When a light emitting color is selected, the driving signal of "H" level is output to the corresponding to output port of the output ports DATA 0 through DATA 2 for the above-mentioned time interval. By this driving signal, the corresponding NPN transistor is made ON for this time interval.

As a result, the current is made to flow through the LED disposed at the position for which the output level of one of the output ports COM 0 through COM 3 is "L", and, also, the output level of one of the output ports DATA 0 through DATA 2 is "H" repeatedly for the above-mentioned time interval. Accordingly, this LED is caused to be lid. This lit state continues unless a relevant command generated according to a predetermined condition in the CPU 5 is changed. When a command for turning off the LED is generated in the CPU 5, the relevant LED is turned off.

Figure 2A:
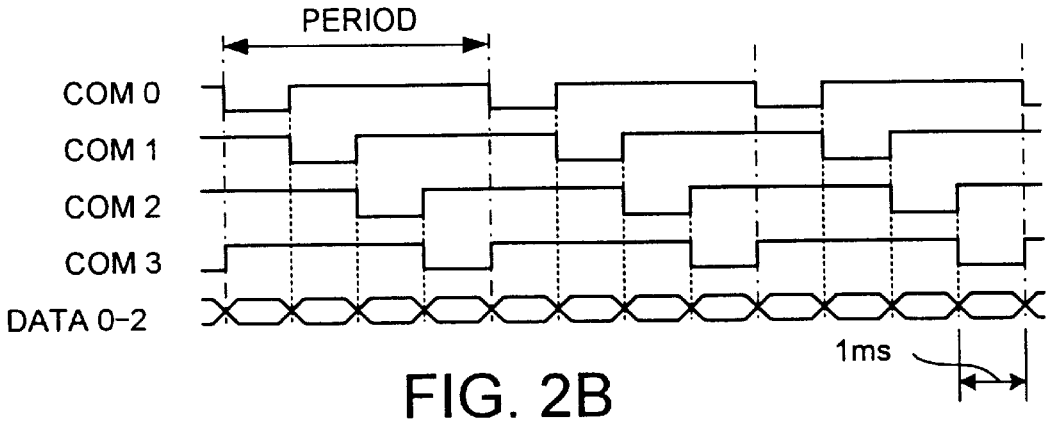
FIG. 2A shows a time chart illustrating operation of the dynamic driving part in each of the first, second and third embodiments of the present invention in a normal mode of an image forming apparatus to which a display device according to the present invention is applied.

FIG. 2A shows the output waveforms at the respective output ports of the CPU 5 while the image forming apparatus operates in its normal mode in each of the first, second and third embodiments. Each of FIGS. 2B, 2C and 2D shows the output waveforms at the respective output ports while the image forming apparatus is in its standby mode, in a respective one of the first, second and third embodiments of the present invention.

While the image forming apparatus operates in the normal mode, as shown in FIG. 2A, the time interval of the output signal at each output port of the CPU 5 is a time interval obtained from dividing one driving period by four uniformly, in a case of the 4×3 LED matrix type. Thereby, the driving current is made to flow through the LED in the lit state repeatedly for the time interval at the duty ratio of ¼. Thus, this LED is lit in a bright lit condition.

In a case where operation states of respective parts of the apparatus or the like are continuously displayed by the LEDs in the operation panel (display device) without disconnecting it from the power source even when the operation mode of the image forming apparatus is changed into the standby mode, no power saving of the operation panel can be rendered. That is, in this condition, the driving current continues to flow at the above-mentioned time intervals (that is, at the duty ratio of ¼). Accordingly, the relevant LED continues in the bright lit state, and, as a result, power saving on the LED cannot be rendered, and, also, it is not possible to indicate to the user that the operation mode of the apparatus is changed into the standby mode, even after the operation mode of the apparatus is changed into the standby mode actually.

Figure 2B:
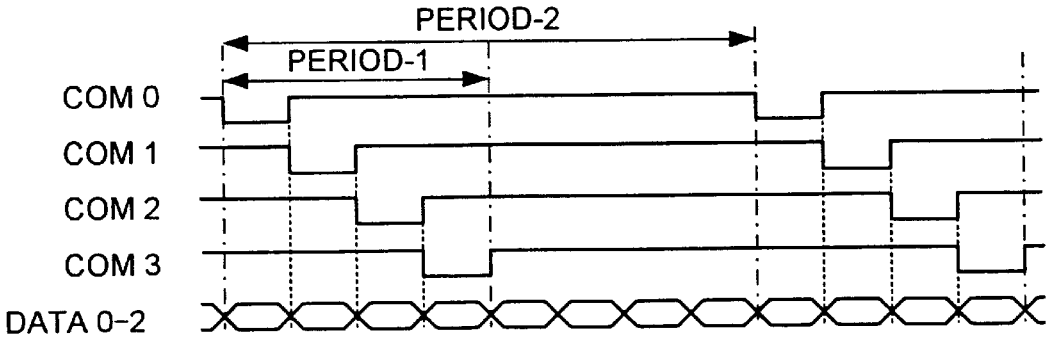
FIG. 2B shows a time chart illustrating operation of the dynamic driving part in the first embodiment of the present invention in a standby mode of the image forming apparatus.
Figure 2C:
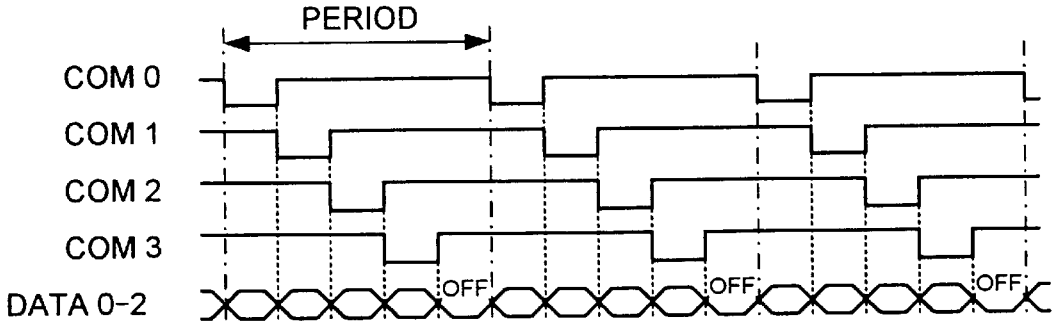
FIG. 2C shows a time chart illustrating operation of the dynamic driving part in the second embodiment of the present invention in the standby mode of the image forming apparatus.
Figure 2D:
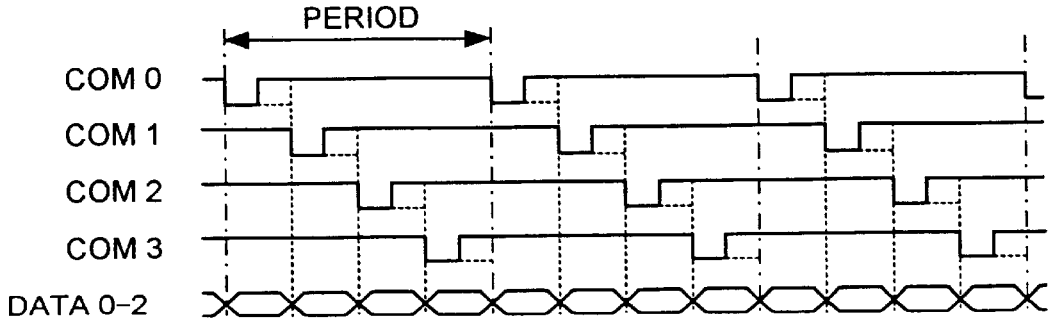
FIG. 2D shows a time chart illustrating operation of the dynamic driving part in the third embodiment of the present invention in the standby mode of the image forming apparatus.

FIG. 2B shows a case in the first embodiment of the present invention in which, when the operation mode of the image forming apparatus is changed to the standby mode, the duty ratio of the LED driving current is variably controlled, without addition of any special circuit. Specifically, when the CPU 5 determines that the operation mode of the image forming apparatus is changed into the standby mode according to a predetermined condition, the CPU 5 drives the LED driving part in a curtailed driving condition in which driving is rendered only once per a plurality of driving periods (in the first embodiment shown in FIG. 2B, once per two driving periods). As a result, the driving power of the operation panel (LEDs) can be reduced, and, also, the relevant LED enters a dark lit state in which the brightness of the LED is reduced according to a curtailing degree of the above-mentioned curtailed condition. Thereby, it is possible to indicate to the user clearly that the operation mode of the image forming apparatus is changed into the standby mode (it is noted that, each driving time interval is, for example, 1 millisecond, as shown in FIG. 2A, and, in this example, each driving period is 4 milliseconds. Accordingly, a human being can not recognize blinking, but recognizes as if the brightness of the LED is lower in the case of FIG. 2B than in the case of FIG. 2A).

In this case, as the driving period of the LED in the lit state is substantially extended in the case of FIG. 2B (twice), flickering may occur in this LED due to interference with the commercial frequency or the like. In order to prevent the flickering from occurring, it is possible that, by reducing each driving period while the above-mentioned curtailing degree is maintained, the LED is lit at the intervals the same as those in the normal mode.

FIG. 2C shows the case of the second embodiment of the present invention. In this case, when the CPU 5 determines to change into the standby mode, the LED driving period is divided by 5 which is more than the number 4 of the LED matrix by one in the case of the 4×3 LED matrix type, into five time intervals, and, a non-lighting cycle/non-driving cycle, in which the driving signal is output at none of the output ports COM 0 through COM 3 and DATA 0 through DATA 2, into each driving period (at the end in this embodiment). As a result, the duty ratio in the driving current for each LED in its lit state is reduced to ⅕ from ¼ which is in the normal mode. Accordingly, the power consumption of the operation panel is reduced by 20% in the standby mode in comparison to the case of the normal mode. Furthermore, the brightness (light emitting intensity) of the LED in its lit state decreases accordingly in comparison to the case of the normal mode. Thereby, the user can easily recognize that the current operation mode of the image forming apparatus is the standby mode.

In the above-described case shown in FIG. 2C in the second embodiment, not only the common driver 1 (COM 0 through COM 4) but also the data driver 4 (DATA 0 through DATA 2) are not driven at al in each non-driving cycle mentioned above. However, when all the base voltages of the PNP transistors $TR_0$ through $TR_3$ of the common driver 1 are in the high (H) level, all these transistors are in its OFF states. Accordingly, no LED is lit regardless of the ON/OFF states of the NPN transistors of the data driver 4. As a result, the output signal for the output ports DATA 0 through DATA 2 for the data driver 4 does not need to be defined.

Further, in the above-described second embodiment shown in FIG. 2C, the driving period of the LEDs is not changed, while the time interval of the output signal is reduced by 20% for each output port. However, it is also possible that the time interval of the output signal for each output port is not changed from that of the normal mode, while the LED driving period is elongated so that the non-driving cycle of the same time interval can be inserted thereto. However, in this case, the driving period of the LED in its lit state is elongated. Accordingly, flickering may occur due to interference with the commercial frequency or the like. In order to prevent flickering, the driving period is made equal to that of the normal mode as shown in FIG. 2C.

In the above-described second embodiment, the driving period is divided by 5 which is more than the number of the LED matrix by one into the five time cycles. However, it is also possible that the driving period is divided into an arbitrary number of time cycles which is more than the number (4, in this case) of the LED matrix, and, all the number of time cycles exceeding the number of the LED matrix are the non-driving cycles. Thereby, it is possible to set the degree of power saving of the operation panel arbitrarily.

FIG. 2D illustrates the third embodiment of the present invention. In the third embodiment, when the CPU 5 determines to change the operation mode of the image forming apparatus into the standby mode, the CPU 5 reduces each driving time interval for driving the common driver 1, instead of inserting the non-driving cycle as in the second embodiment. In this case, the driving period of the LED in its lit state is the same as that of the normal mode, and, also, the time interval from the start of driving of one PNP transistor $TR_i$ (i=0 through 3) to the start of driving of the subsequent PNP transistor $TR_{i+1}$ is the same as that of the normal state.

Also in this embodiment, it is possible to reduce the power consumption by an amount by which each driving time interval of the common driver 1 is reduced, and, also, the light emitting intensity of the LED in its lit state decreases accordingly. The degree of reduction in driving time interval is determined according to the ratio of necessary power saving degree of the operation panel, the degree of conspicuousness in indicating to the user of the change of the operation mode, and so forth.

Further, in the third embodiment shown in FIG. 2D, the former half of each driving time interval is made remain and the latter half thereof is cut. However, which portion of each driving interval is made remain is not particularly defined. Further, it is also possible that also the driving signal for the data driver 4 is not output for the interval corresponding to the interval for which the driving signal is not output for the common driver 1 in each driving time interval.

Each of the above-described embodiments of the present invention can be achieved merely by modifying data which determines the driving period and driving time interval, without changing the basic control program stored in the ROM 2 drastically. Accordingly, it is possible to achieve the object without substantial increase of program capacity.

Figure 3:
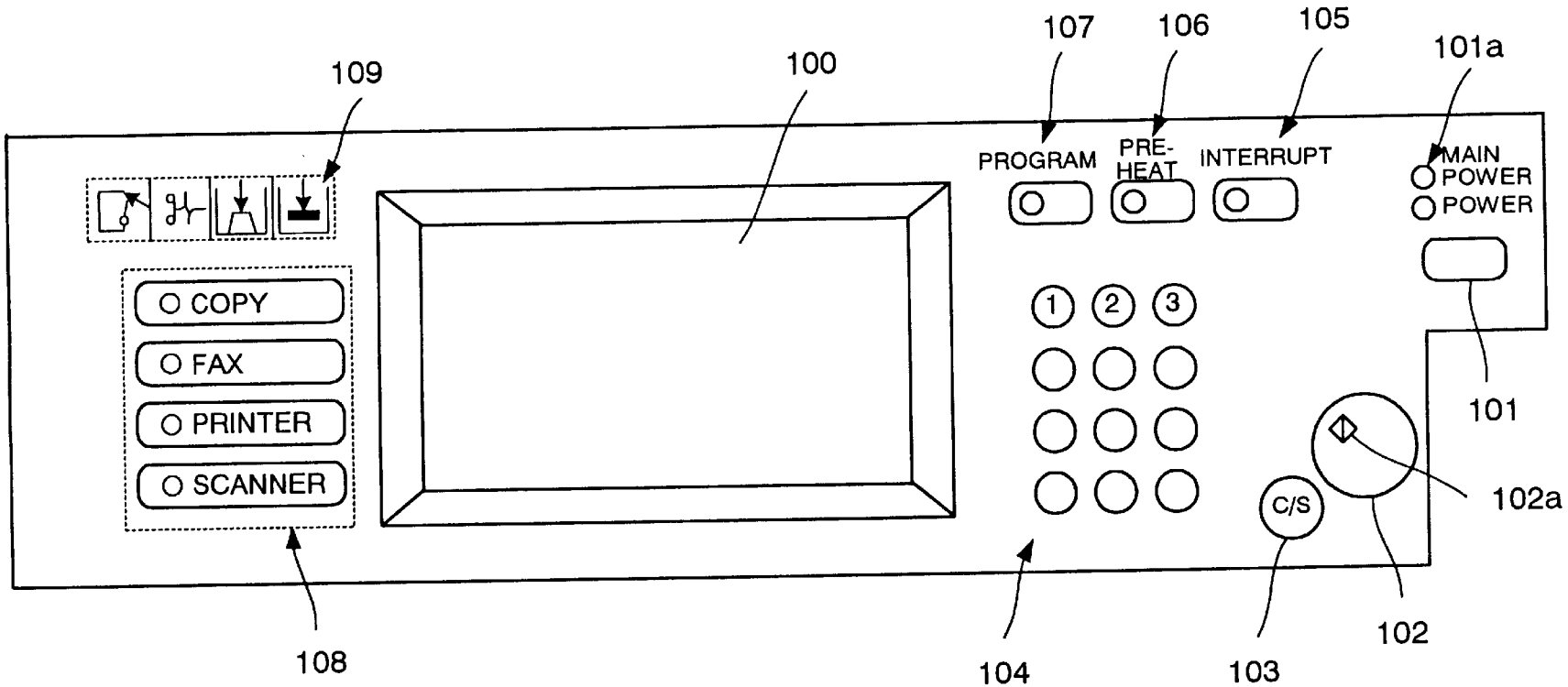
FIG. 3 shows one example of an operation panel of the image forming apparatus to which the display device according to the present invention is applied.

FIG. 3 shows one example of the operation panel of the image forming apparatus in each of the above-mentioned first, second and third embodiments of the present invention. LEDs of the operation panel is controlled by the dynamic LED driving part described above in the manner also described above according to the present invention.

As shown in FIG. 3, the operation panel includes a LCD 100 for displaying states of various parts of the apparatus, a power key 101, a main power LED and a power LED 101*a*, a start key 102, start LEDs (red and green) 102*a*, a clear/stop key 103, ten-keys 104, interrupt key and LED 105 (part indicated by ○, the same manner hereinafter), pre-heating key and LED 106, program key and LED 107, application keys and LEDs 108, and alert display LEDs 109.

In the above-mentioned parts, the LEDs 101*a*, 102*a*, 105, 107, 108 and 109 correspond to the LEDs of the above-mentioned group of LEDs 2 shown in FIG. 1.

Figure 4:
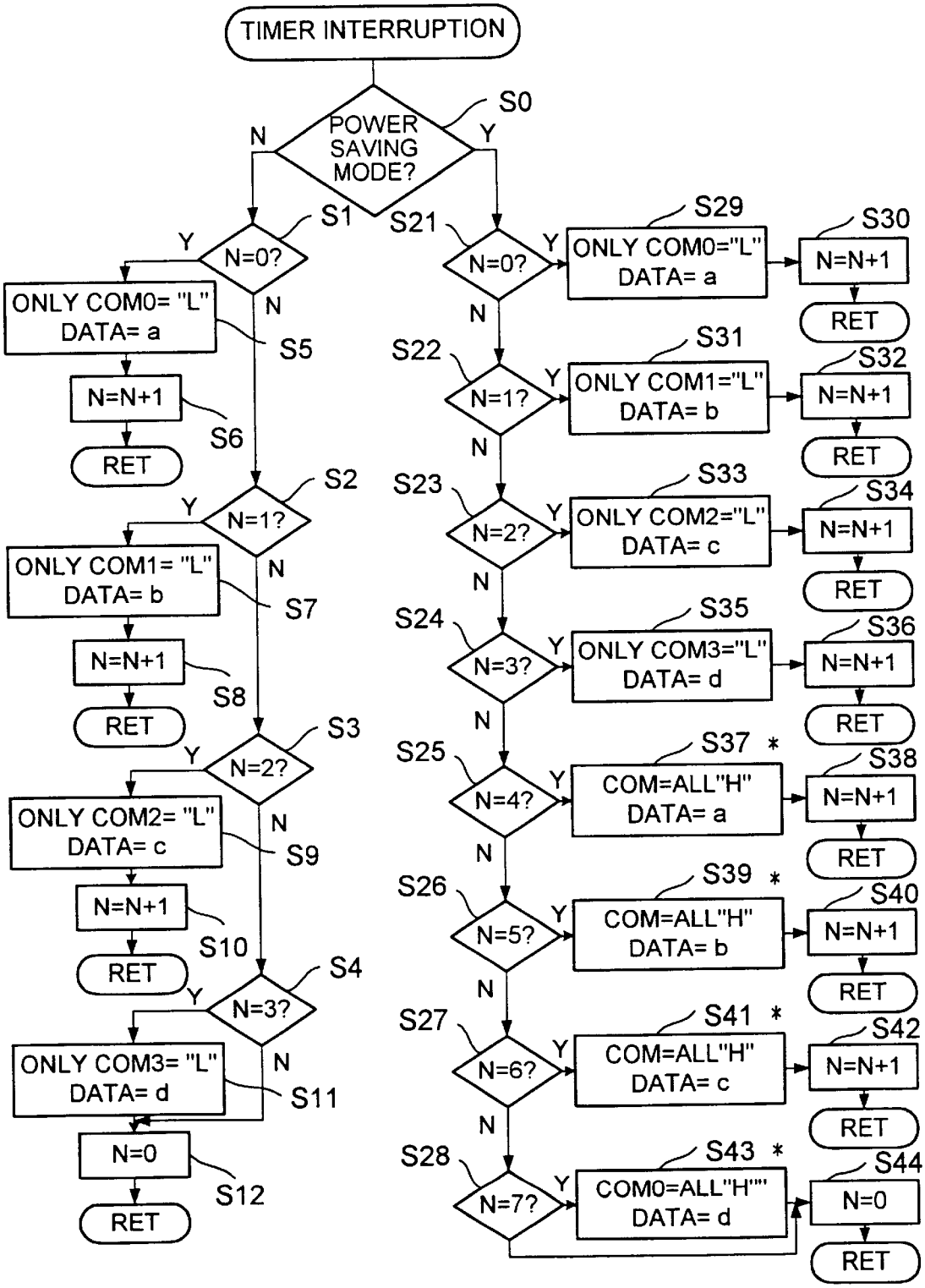
FIG. 4 shows a flow chart of the operation in the first embodiment of the present invention.

FIG. 4 shows a flow chart of operation in the above-mentioned first embodiment of the present invention performed by the CPU 5.

In FIG. 4, in a step S0, it is determined whether the operation mode is the standby mode (power saving mode). When the operation mode is not the standby mode, a step S1 is performed, while predetermined clock pulses are counted. In the step S1, when the count value is 0, the L signal is output only to the output port COM 0 in a step S5.

Then, when the count value is 1, a step S7 is performed after a step S2, and, the L signal is output only to the output port COM 1. Then, when the count value is 2, a step S9 is performed after a step S3, and, the L signal is output only to the output port COM 2. Then, when the count value is 2, a step S11 is performed after a step S4, and, the L signal is output only to the output port COM 3. Then, a step S12 is performed, the count value is reset to 0, and the operation is returned to the step S0.

When it is determined in the step S0 that the operation mode is the standby mode, a step S21 is performed, while the clock pulses are counted. Then, when the count value is 0, the L signal is output only COM 0 in step S29. Then, same as the above-mentioned steps S2, S7, S3, S9, S4 and S11, when the count value is 1, 2 and, then, 3, the L signal is output only to COM 1, COM 2 and, then, COM 3, in sequence.

Then, when the count value is 4 (that is, the second driving period in FIG. 2B), a step S37 is performed after a step S25, and, then, the H signal is output to all the output ports COM 0 through COM 3. Then, similarly, when the count value is 5, 6, and, then, 7, the H signal is output to all the output ports COM 0 through COM 3, in each of steps of S26, S39, S27, S41, S28, and, then, S43.

Then, in a step S44, the count value is reset to 0, and the operation is returned to the step S0.

The period of the above-mentioned clock pulses corresponds to the time interval for each output port in FIG. 2B (in the above-mentioned example, 1 millisecond).

Through the above-described operation, as shown in FIG. 2B, the L signal is output to the output ports COM 0 through COM 3 in sequence in each odd driving period. In each even driving period, the H signal is always output to all the output ports COM 0 through COM 3.

Figure 5:
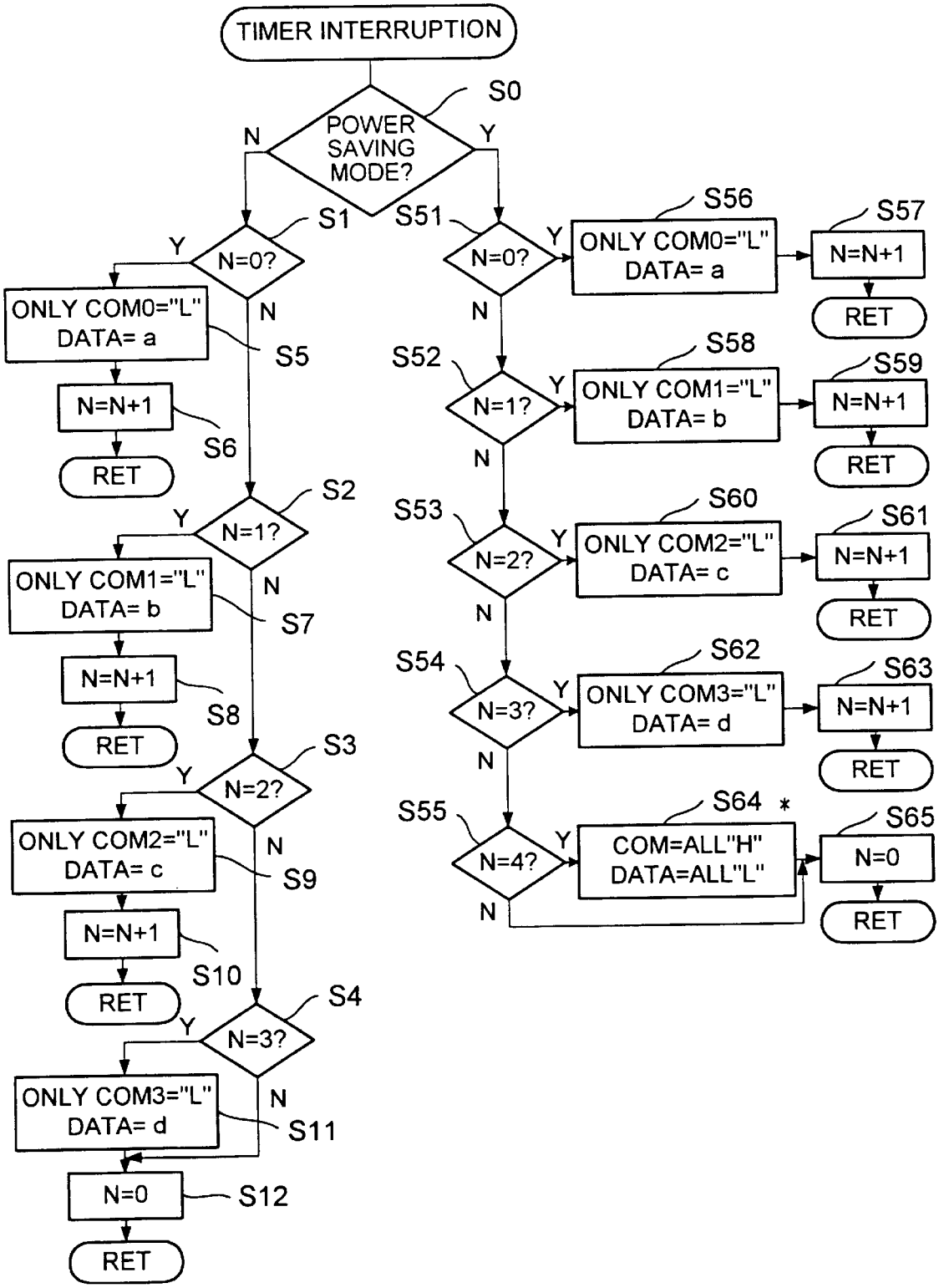
FIG. 5 shows a flow chart of the operation in the second embodiment of the present invention.

FIG. 5 shows a flow chart of the operation in the above-mentioned second embodiment of the present invention described with reference to FIG. 2C performed by the CPU 5.

The operation in the steps S1 through S12 after the step 1 is performed after the step S0 is the same as the operation in the steps S1 through S12 after the step 1 is performed after the step S0 in FIG. 4.

When the operation mode is the standby mode in the step S0 in FIG. 5, the step S51 is performed while the clock pulses are counted. In the step S51, when the count value is 0, a step S56 is performed and the L signal is output only to the output port COM 0.

Then, when the count value is 1, a step S58 is performed after a step S52, and the L signal is output only to COM 1. Similarly, when the count value is 2, a step S60 is performed after a step S53, and the L signal is output only to COM 2. Similarly, when the count value is 3, a step S62 is performed after a step S54, and the L signal is output only to COM 3. Similarly, when the count value is 4, a step S64 is performed after a step S55, and the H signal is output to all COM 0 through COM 3. Then, in a step S65, the count value is reset to 0, and the operation is returned to the step S0.

Through the above-described operation, as shown in FIG. 2C, after the L signal is output to COM 0 through COM 3 in sequence, the H signal is output to all COM 0 through COM 3 at the end of each driving period.

Figure 6:
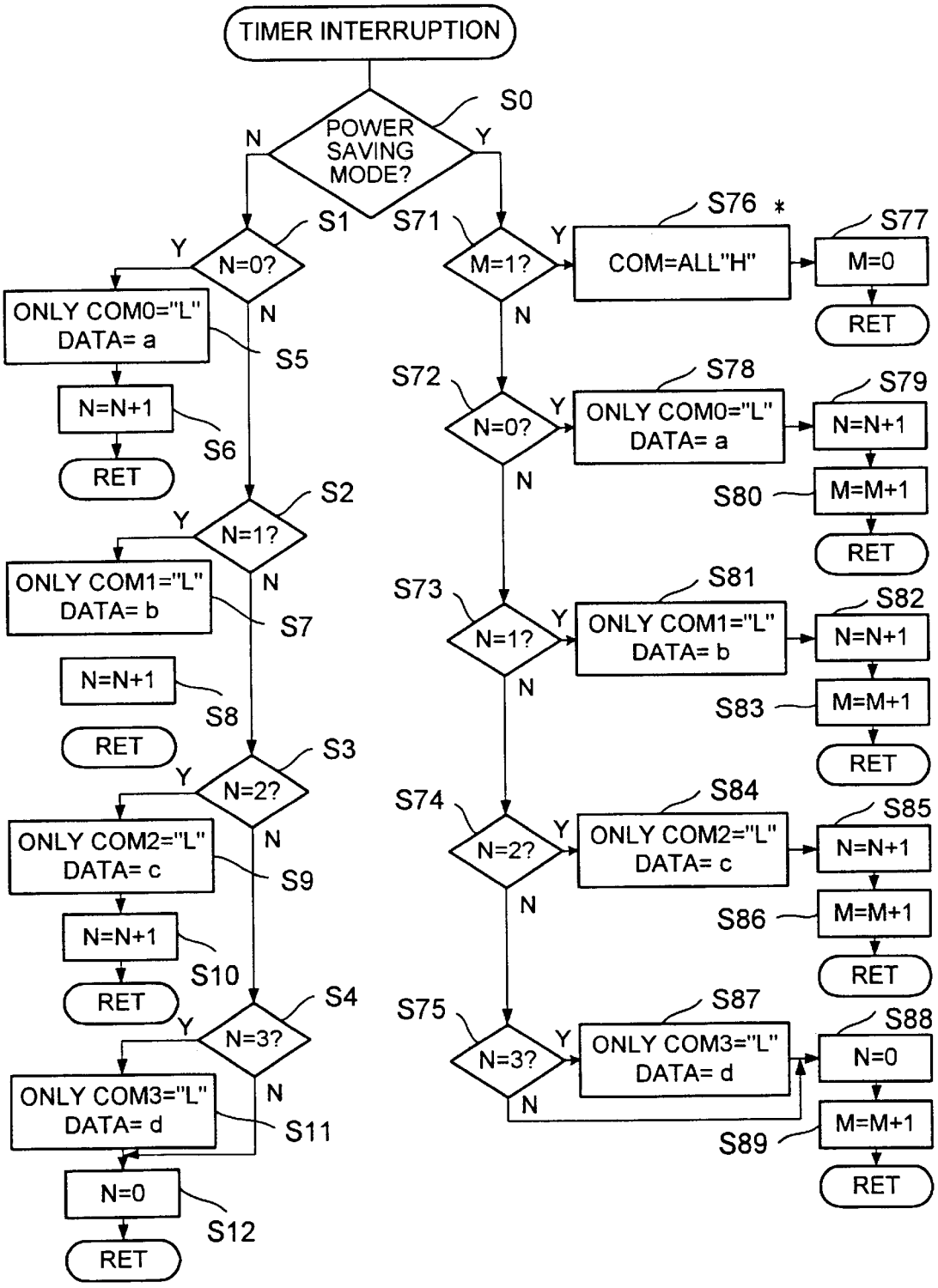
FIG. 6 shows a flow chart of the operation in the third embodiment of the present invention.

FIG. 6 shows a flow chart operation in the third embodiment of the present invention with reference to FIG. 2D performed by the CPU 5.

In this embodiment, predetermined clock pulses counted in the standby mode (power saving mode, steps S71 through S89) have the period half the period (frequency twice the frequency) of the predetermined clock pulses counted in the normal mode (steps S1 through S12).

The operation in the steps S through S12 after the step 1 is performed after the step S0 is the same as the operation in the steps S1 through S12 after the step 1 is performed after the step S0 in FIG. 4.

When the operation mode is the standby mode (power saving mode) in the step S0, while the above-mentioned clock pulses of the half period are counted, and, when the count value of a predetermined counter M is 1 in a step S71, the H signal is output to all COM 0 through COM 3. Then, in a step S77, the count value of the counter M is reset to 0 (the end of each driving period in FIG. 2D). Then, the operation is returned to the step S0.

Then, in the step S71, as the counter M is reset to 0, a step S72 is then performed. When another predetermined counter N is 0, a step S78 is then performed, and the L signal is output only to COM 0. Then, both counters N and M count in steps S79 and S80.

Then, in the step S71, because M=1, the H signal is output to all COM 0 through COM 3 in a step S76, and the counter M is reset to 0. As a result, N=1, M=0. Then, the operation is returned to S0.

Then, in the step S71, as the counter M is reset to 0, a step S72 is then performed. Then, as the counter N is 1, a step S81 is then performed after a step S73, and the L signal is output only to COM 1. Then, both counters N and M count in steps S82 and S83. As a result, N=2 and M=1. Then, the operation is returned to the step S0.

Then, in the step S71, because M=1, the H signal is output to all COM 0 through COM 3 in a step S76 as mentioned above, and the counter M is reset to 0. As a result, N=2, M=0. Then, the operation is returned to S0.

Then, in the step S71, as the counter M is reset to 0, a step S72 is then performed. Then, as the counter N is 2, a step S84 is then performed after the step S73 and a step S74, and the L signal is output only to COM 2. Then, both counters N and M count in steps S85 and S86. As a result, N=3 and M=1. Then, the operation is returned to the step S0.

Then, in the step S71, because M=1, the H signal is output to all COM 0 through COM 3 in a step S76 as mentioned above, and the counter M is reset to 0. As a result, N=3, M=0. Then, the operation is returned to S0.

Then, in the step S71, as the counter M is reset to 0, a step S72 is then performed. Then, as the counter N is 3, a step S87 is then performed after the steps S73, S74 and a step S75, and the L signal is output only to COM 3. Then, the counter N is reset to 0, and the counter M counts in steps S88 and S89. As a result, N=0 and M=1. Then, the operation is returned to the step S0.

Then, in the step S71, because M=1, the H signal is output to all COM 0 through COM 3 in a step S76 as mentioned above, and the counter M is reset to 0. As a result, N=0, M=0. Then, the operation is returned to S0.

Then, the above-described operation (steps S71 through S89) is repeated.

Through the above-described operation, as shown in FIG. 2D, at the time intervals each (0.5 milliseconds, in the above-mentioned example) being half each of the time intervals for the respective output ports in the normal mode (FIG. 2A), first, the L signal is output only to COM 0. Then, the H signal is output to all COM 0 through COM 3. Then, after the L signal is output only to COM 1, the H signal is output to all COM 0 through COM 3. Similarly, after the L signal is output only to COM 2, the H signal is output to all COM 0 through COM 3. At the end, after the L signal is output only to COM 3, the H signal is output to all COM 0 through COM 3. Then, the above-described operation is repeated.

Figure 7:
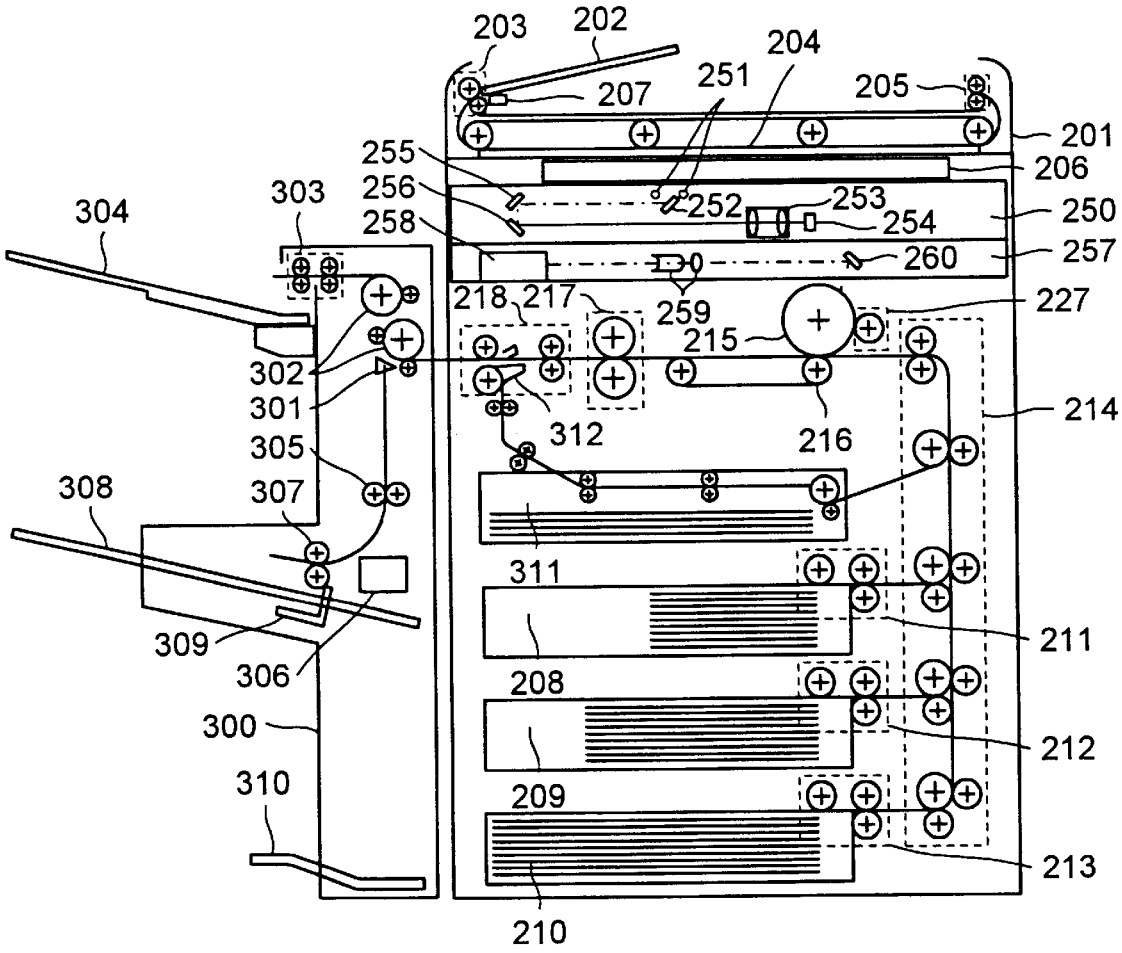
FIG. 7 shows a general side-elevational sectional view of an example of the image forming apparatus according to the present invention.

FIG. 7 shows one example of the image forming apparatus in each of the above-mentioned first, second and third embodiments of the present invention.

Although not shown in FIG. 7, the operation panel such as that shown in FIG. 3, and the CPU 5, ROM 7, RAM 8, and the dynamic driving part, shown in FIG. 1, are included in this image forming apparatus. Then, through the CPU 5 and so forth, the operation of the entirety of the image forming apparatus including image forming operation which will now be described is performed. At this time, the operation panel is used as an interface between the apparatus and the user, and, predetermined operation including the image formation operation is performed in accordance with operation performed by the user on the operation panel.

Further, the operation described with reference to FIGS. 2A, 2B, 2C, 2D, 4, 5 and 6 may be performed, as a result of the CPU 5 executing the program, together with the ROM 7 and ROM 8, which is previously recorded in a carriable recording medium such as a CD-ROM (12*a* in FIG. 1) or the like, is read through a CD-ROM drive 12, is then written to a hard-disk drive 11 or the like.

In the configuration shown in FIG. 7, an original paper sheet set on an automatic draft feeder (ADF) 201 or a draft table 202 is fed to a predetermined place appropriately, and image information thereof is read by a reading unit 250 (exposure lamp 251, mirrors 252, 255, 256, lens 253, CCD image sensor 254 and so forth), so that an image signal is generated. Then, the image signal is transferred to a writing unit 257 or sent to a facsimile machine on the other end via a communication line.

Then, the image signal transferred from the reading unit or sent from a facsimile machine on the other end is converted into an optical signal by the writing unit 257. Then, the optical signal in a form of a laser beam is emitted from a laser output unit 258, and, an imaging and scanning process is carried out through a scanning and imaging optical system including an imaging lens 259, a mirror 260 and a polygon mirror (not shown in the figure). Thereby, a photosensitive body 215 is scanned by the laser beam, and an electrostatic latent image is formed on the photosensitive body. This latent image is developed by a developing unit 227 using toner. The thus-produced toner image is transferred onto a transfer paper, and, then, is fixed to the paper by a fixing unit 217. Then, the paper is conveyed through and ejected from the image forming apparatus through conveying and ejecting mechanisms 301, 302, 303, 304, 305, 306, 307, 308, 309 and 310.

Thus, according to the image signal, the desired image is formed, is transferred to the transfer paper, and is output.

The present invention is not limited to the above-described embodiments, and variations and modifications may be made without departing from the scope of the present invention.

The present application is based on Japanese priority application No. 2000-098613, filed on Mar. 31, 2000, the entire contents of which are hereby incorporated by reference.

What is claimed is:

1. A display device comprising:

first and second driving parts connected in series with light-emitting diodes disposed in a matrix configuration to drive said light-emitting diodes in a time-division manner, and said light-emitting diodes are lit when said first and second driving parts are driven simultaneously, wherein a driving period of at least one of said first and second driving parts is dynamically changed in a case of a predetermined operation mode, and a driving time interval in the driving period is fixed when the driving period is changed.

2. The display device as claimed in claim 1, wherein a non-driving period of at least one of said first and second driving parts is inserted.

3. The display device as claimed in claim 1, wherein a number of time intervals in a driving period is increased.

4. The display device as claimed in claim 1, wherein said predetermined operation mode comprises a power-saving mode or a standby mode.

5. A display device comprising:

first and second driving parts connected in series with light-emitting diodes disposed in a matrix configuration to drive said light-emitting diodes in a time-division manner, and said light-emitting diodes are lit when said first and second driving parts are driven simultaneously, wherein a non-driving cycle in which at least one of said first and second driving parts is not driven is inserted into a driving period of said first and second driving parts in a case of a power-saving mode or a standby mode.

6. An image forming apparatus exposing a photosensitive body by an optical signal according to given image information so as to form a latent image, and developing the latent image so as to render a desired image, wherein said apparatus includes a display device comprising:

first and second driving parts connected in series with light-emitting diodes disposed in a matrix configuration to drive said light-emitting diodes in a time-division manner, and said light-emitting diodes are lit when said first and second driving parts are driven simultaneously, wherein a driving period of at least one of said first and second driving parts is dynamically changed in a case of a predetermined operation mode of said apparatus, and a driving time interval in the driving period is fixed when the driving period is changed.

7. The apparatus as claimed in claim 6, wherein a non-driving period of at least one of said first and second driving parts is inserted.

8. The apparatus as claimed in claim 6, wherein a number of time intervals in a driving period is increased.

9. The apparatus as claimed in claim 6, wherein said predetermined operation mode comprises a power-saving mode or a standby mode.

10. An image forming apparatus exposing a photosensitive body by an optical signal according to given image information so as to form a latent image, and developing the latent image so as to render a desired image, wherein said apparatus includes a display device comprising:

first and second driving parts connected in series with light-emitting diodes disposed in a matrix configuration to drive said light-emitting diodes in a time-division manner, and said light-emitting diodes are lit when said first and second driving parts are driven simultaneously, wherein a non-driving cycle in which at least one of said first and second driving parts is not driven is inserted into a driving period of said first and second driving parts in a case of a power-saving mode or a standby mode.

11. A recording medium in which a software program is recorded for causing a computer to perform operation of a display device comprising:

first and second driving parts connected in series with light-emitting diodes disposed in a matrix configuration to drive said light-emitting diodes in a time-division manner, and said light-emitting diodes are lit when said first and second driving parts are driven simultaneously, wherein a driving period of at least one of said first and second driving parts is dynamically changed in a case of a predetermined operation mode in the software program recorded in said recording medium, and a driving time interval in the driving period is fixed when the driving period is changed.

12. The recording medium as claimed in claim 11, wherein, a non-driving period of at least one of said first and second driving parts is inserted in the software program recorded in said recording medium.

13. The recording medium as claimed in claim 11, wherein a number of time intervals in a driving period is increased in the software program recorded in said recording medium.

14. The recording medium as claimed in claim 11, wherein said predetermined operation mode in the software program recorded in said recording medium comprises a power-saving mode or a standby mode.

15. A recording medium in which a software program is recorded for causing a computer to perform operation of a display device comprising:

first and second driving parts connected in series with light-emitting diodes disposed in a matrix configuration to drive said light-emitting diodes in a time-division manner, and said light-emitting diodes are lit when said first and second driving parts are driven simultaneously, wherein a non-driving cycle in which at least one of said first and second driving parts is not driven is inserted into a driving period of said first and second driving parts in a case of a power-saving mode or a standby mode in the software program recorded in said recording medium.

16. A display method of displaying in a display device in which first and second driving parts are connected in series with light-emitting diodes disposed in a matrix configuration to drive said light-emitting diodes in a time-division manner, and said light-emitting diodes are lit when said first and second driving parts are driven simultaneously, comprising:

dynamically changing a driving period of at least one of said first and second driving parts in a case of a predetermined operation mode; and fixing a driving time interval in the driving period when the driving period is changed.

17. The method as claimed in claim 16, further comprising:

inserting a non-driving period of at least one of said first and second driving parts.

18. The method as claimed in claim 16, further comprising:

increasing a number of time intervals in a driving period.

19. The method as claimed in claim 16, wherein said predetermined operation mode comprises a power-saving mode or a standby mode.

20. A display method of displaying in a display device in which first and second driving parts are connected in series with light-emitting diodes disposed in a matrix configuration to drive said light-emitting diodes in a time-division manner, and said light-emitting diodes are lit when said first and second driving parts are driven simultaneously, comprising:

inserting into a driving period of said first and second driving parts a non-driving cycle in which at least one of said first and second driving parts is not driven in a case of a power-saving mode or a standby mode.

* * * * *